US011751602B2

(12) United States Patent
Kolyris

(10) Patent No.: US 11,751,602 B2
(45) Date of Patent: Sep. 12, 2023

(54) SHISHA DEVICE FOR HEATING A SUBSTRATE WITHOUT COMBUSTION

(71) Applicant: PHILIP MORRIS PRODUCTS S.A., Neuchatel (CH)

(72) Inventor: Angelos Kolyris, St-Sulpice (CH)

(73) Assignee: Philip Morris Products S.A., Neuchatel (CH)

( * ) Notice: Subject to any disclaimer, the term of this patent is extended or adjusted under 35 U.S.C. 154(b) by 148 days.

(21) Appl. No.: 16/090,684

(22) PCT Filed: Apr. 5, 2017

(86) PCT No.: PCT/IB2017/051969
§ 371 (c)(1),
(2) Date: Oct. 2, 2018

(87) PCT Pub. No.: WO2017/178932
PCT Pub. Date: Oct. 19, 2017

(65) Prior Publication Data

US 2020/0022408 A1 Jan. 23, 2020

(30) Foreign Application Priority Data

Apr. 11, 2016 (EP) ..... 16164759

(51) Int. Cl.
*A24F 1/30* (2006.01)
*A24F 40/30* (2020.01)
(Continued)

(52) U.S. Cl.
CPC ..... *A24F 1/30* (2013.01); *A24F 40/30* (2020.01); *A24F 40/46* (2020.01); *A24F 40/50* (2020.01); *A24F 40/20* (2020.01)

(58) Field of Classification Search
CPC ..... A24F 47/008; A24F 1/30; A24F 40/50
(Continued)

(56) References Cited

U.S. PATENT DOCUMENTS 5,179,966 A * 1/1993 Losee ..... A24F 47/008 128/202.21
5,269,327 A 12/1993 Counts et al.
(Continued)

FOREIGN PATENT DOCUMENTS

CN 203952442 U 11/2014
EP 2845497 3/2015
(Continued)

OTHER PUBLICATIONS

Machine Translation of CN 203952442 (Year: 2014).*
(Continued)

*Primary Examiner* — Russell E Sparks
(74) *Attorney, Agent, or Firm* — Mueting Raasch Group

(57) ABSTRACT

A shisha device (100) comprises multiple receptacles for receiving a plurality of consumables (20) comprising aerosol-generating substrate. In addition or alternatively, a shisha device comprises an electrical heating element configured to penetrate into an aerosol-generating substrate. Preferably, the shisha devices heat the aerosol-generating substrate in the consumables to an extent sufficient to generate an aerosol without combusting the substrate. The device may include control electronics operably coupled to the heating elements and configured to cause a first heating element to heat an aerosol-generating substrate of a first consumable received by a first receptacle until the aerosol-generating substrate is depleted or nearly depleted prior to causing a second heating element to heat an aerosol-generating substrate of a second consumable received by a second receptacle.

8 Claims, 5 Drawing Sheets

Figure 1:
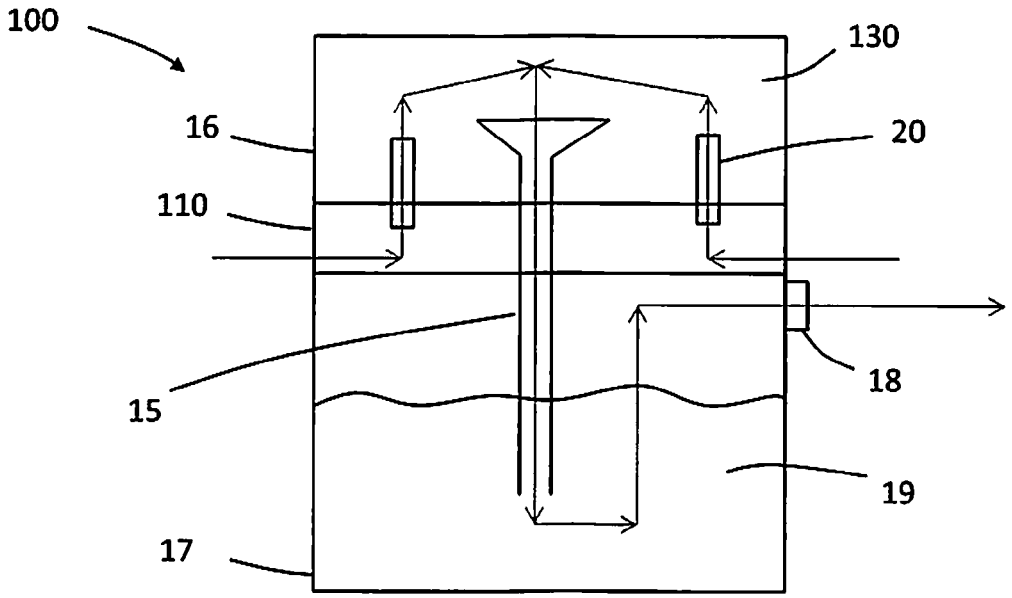

(51) Int. Cl.
*A24F 40/50* (2020.01)
*A24F 40/46* (2020.01)
*A24F 40/20* (2020.01)

(58) Field of Classification Search
USPC ..... 131/328
See application file for complete search history.

(56) References Cited

U.S. PATENT DOCUMENTS

| | | | | |
|---|---|---|---|---|
| 9,888,714 | B2 * | 2/2018 | Cameron | A24F 40/50 |
| 11,006,669 | B2 * | 5/2021 | Reevell | G01F 23/22 |
| 2014/0255014 | A1 | 9/2014 | Bishara | |
| 2015/0136154 | A1 | 5/2015 | Mitrev et al. | |
| 2015/0272214 | A1 | 10/2015 | Giller | |
| 2016/0029696 | A1 | 2/2016 | Obeidallah | |
| 2016/0066619 | A1 | 3/2016 | DiCarlo | |

FOREIGN PATENT DOCUMENTS

| | | | | |
|---|---|---|---|---|
| RU | 111400 | U1 | 12/2011 | |
| RU | 124870 | U1 | 2/2013 | |
| WO | WO 2006/085126 | A1 | 8/2006 | |
| WO | WO 2010/061233 | A2 | 6/2010 | |
| WO | WO 2014/118787 | | 8/2014 | |
| WO | WO 2016/010864 | A1 | 1/2016 | |
| WO | WO-2016177604 | A1 * | 11/2016 | A61M 15/0003 |

OTHER PUBLICATIONS

Machine Translation of W02016177604 (Year: 2023).*
Extended European Search Report for EP 16164759.9, issued by the European Patent Office, dated Jan. 17, 2017; 9 pgs.
International Search Report and Written Opinion for PCT/IB2017/051969, issued by the European Patent Office, dated Aug. 16, 2017; 19 pgs.
International Preliminary Report on Patentability for PCT/IB2017/051969, issued by the European Patent Office, dated Jul. 23, 2018; 16 pgs.
Decision to Grant and Search Report issued in the related RU Application No. 2018136257, by the Patent Office of the Russian Federation dated Mar. 24, 2020; 21 pgs. including English Translation.
Chinese Office Action issued in CN201780018120.6 by the China National Intellectual Property Administration, Nov. 20, 2020; 19 pgs including English Translation.

* cited by examiner

SHISHA DEVICE FOR HEATING A SUBSTRATE WITHOUT COMBUSTION

This application is the § 371 U.S. National Stage of International Application No. PCT/IB2017/051969, filed 5 Apr. 2017, which claims the benefit of European Application No. 16164759.9, filed 11 Apr. 2016.

This disclosure relates to shisha devices; and more particularly to shisha devices configured to heat tobacco without combusting the tobacco.

Shisha devices are used to smoke tobacco and are configured such that vapour and smoke pass through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapour and smoke produced, to alter flavour, or both. Charcoal pellets are typically used to heat the tobacco in a shisha device, which may cause full or partial combustion of the tobacco or other ingredients.

Some shisha devices have been proposed that use electrical heat sources to combust the tobacco to, for example, avoid by-products of burning charcoal or to improve the consistency with which the tobacco is combusted. Other shisha devices have been proposed that employ e-liquids rather than tobacco. Shisha devices that employ e-liquids eliminate combustion by-products, but deprive shisha consumers of the tobacco-based experience.

It is desirable to provide a shisha device that employs a substrate that does not result in combustion by-products.

It is also desirable to provide a shisha device configured for use with an aerosol-generating substrate, such as a tobacco substrate, in a convenient consumable form.

In addition, it is desirable to provide a shisha device that employs one or more conveniently packaged consumables that contain an aerosol generating substrate. It is also desirable for the shisha device to employ the one or more consumables for a period of time that corresponds with the duration typically experienced with a shisha device in which tobacco is combusted.

In various aspects of the present invention there is provided a shisha device comprising a first receptacle, a second receptacle, a first electrical heating element, a second electrical heating element, and control electronics. The first and second receptacles are configured to receive consumables comprising an aerosol-generating substrate. The first heating element is configured to heat the aerosol generating substrate in the first consumable when the first consumable is received in the first receptacle to generate an aerosol. The second heating element is configured to heat the aerosol generating substrate in the second consumable when the second consumable is received in the second receptacle to generate an aerosol. The control electronics are operably coupled to the first and second heating elements and to cause the first heating element to heat the first heating element to heat aerosol-generating substrate of the first consumable received by the first receptacle until the aerosol-generating substrate is depleted or nearly depleted prior to causing the second heating element to heat aerosol-generating substrate of the second consumable received by the second receptacle. Preferably the device is configured such that the heating elements heat the aerosol-generating substrate to an extent sufficient to generate an aerosol without combusting the aerosol-generating substrate.

In some examples, the device is configured such that, in use, the aerosol is at least in part carried through a conduit into liquid disposed in the vessel and exits through the outlet for delivery to a consumer.

In some examples, each consumable contains a charge of aerosol-generating substrate that may be depleted in a time less than the time of a typical shisha session. However, controlled or sequential heating of consumables within the shisha device may extend a session of a device according to the present invention to the time of a typical shisha session.

In some examples, a shisha device of the invention comprises control electronics operably coupled to the plurality of heating elements, wherein the control electronics are configured to cause a first heating element to heat aerosol-generating substrate of a first consumable received by a first receptacle until the aerosol-generating substrate is depleted (or nearly depleted) prior to causing a second heating element to heat aerosol-generating substrate of a second consumable received by a second receptacle. The control electronics may also be configured to cause heating of a third heating element to heat aerosol-generating substrate of a third consumable received by a third receptacle after the aerosol-generating substrate of the second consumable in the second receptacle is depleted (or nearly depleted).

In some examples of shisha devices of the invention, the receptacles are configured to receive consumables comprising aerosol-generating substrate configured to deplete in about 3 minutes to about 8 minutes when heated by one or more of the plurality of heating elements. Preferably, the consumables comprise heat sticks. The device may comprise a sufficient number of receptacles such that sequential heating of aerosol-generating substrate in consumables received by the receptacles results in depletion of the aerosol-generating substrate of the last consumable to be heated at least 30 minutes after initial heating the aerosol-generating substrate of the first consumable to be heated.

As used herein, "depleted," in the context of an aerosol-generating substrate, means that continued heating of the substrate results in no further production of aerosol from the substrate. "Nearly depleted" means that the production of aerosol with continued heating is substantially reduced relative to peak aerosol production. For example, aerosol production may be reduced by 50% or more, 70% or more, or 90% or more.

In various aspects of the present invention there is provided a shisha device comprising a first receptacle, a second receptacle, an aerosol chamber, a first electrical heating element, and a second electrical heating element. The first receptacle is configured to receive a first consumable comprising an aerosol-generating substrate. The second receptacle is configured to receive a second consumable comprising an aerosol-generating substrate. The first electrical heating element is configured to penetrate into the aerosol-generating substrate of the first consumable when received in the second receptacle and to heat the aerosol-generating substrate to generate an aerosol in the aerosol chamber. The second electrical heating element is configured to penetrate into the aerosol-generating substrate of the second consumable when received in the second receptacle and to heat the aerosol-generating substrate to generate an aerosol in the aerosol chamber. Preferably, the device is configured such that the first and second heating elements heat the aerosol-generating substrate to an extent sufficient to generate the aerosol without combusting the aerosol-generating substrate.

In some examples, the shisha device further comprises a vessel comprising an interior configured to contain liquid and comprising an outlet in communication with the interior of the vessel and further comprises a conduit extending from the aerosol chamber to the interior of the vessel. The shisha device is configured such that, in use, the aerosol is at least in part carried through a conduit into liquid disposed in the vessel, and exits through the outlet for delivery to a consumer.

In some examples, a shisha device may comprise a holder defining the first and second receptacles configured to receive the first and second consumables. The heating elements may comprise, for example, a blade configured to pierce consumable to penetrate into the aerosol-generating substrate of the consumable when the consumable is received in the receptacle. The holder may define three or more receptacles. Each receptacle may be configured to receive a consumable comprising aerosol-generating substrate. The device may comprise three or more heating elements. At least one of heating elements may extend into each receptacle. The shisha device may comprise control electronics operably coupled to the heating elements and configured to control heating of the heating elements. In some examples, the control electronics are configured to cause heating of the first heating element extending into the first receptacle until the aerosol-generating substrate of the first consumable in the first receptacle is depleted (or nearly depleted), and configured to cause heating of the second heating element in the second receptacle after the aerosol-generating substrate of the consumable in the first receptacle is depleted (or nearly depleted).

Any suitable aerosol-generating substrate may be used with shisha devices of the invention. The aerosol-generating substrate is preferably a substrate capable of releasing volatile compounds that can form an aerosol. The volatile compounds are released by heating the aerosol-generating substrate. The aerosol-generating substrate may be solid or liquid or comprise both solid and liquid components. In a preferred embodiment, the aerosol-generating substrate is solid.

The aerosol-generating substrate may comprise nicotine. The nicotine containing aerosol-generating substrate may comprise a nicotine salt matrix. The aerosol-generating substrate may comprise plant-based material. The aerosol-generating substrate may comprise tobacco, and preferably the tobacco containing material contains volatile tobacco flavor compounds, which are released from the aerosol-generating substrate upon heating.

The aerosol-generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 5% and 30% by weight on a dry weight basis.

The aerosol-generating substrate may alternatively or additionally comprise a non-tobacco-containing material. The aerosol-generating substrate may comprise homogenized plant-based material.

The aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-generating substrate preferably comprises nicotine and at least one aerosol-former. In a particularly preferred embodiment, the aerosol-former is glycerine.

Preferably the aerosol-generating substrate comprises about 40% water by weight or less, such as about 30% or less, about 25% or less or about 20% or less. For example, the aerosol-generating substrate may comprise 5% to about 30% water by weight.

Preferably the aerosol-generating substrate is in solid form rather that in a fluid forms. Preferably the solid aerosol-generating substrate holds its shape. The solid aerosol-generating substrate may be in loose form, or may be provided in a suitable consumable such as container or cartridge.

The solid aerosol-forming substrate may be provided on or embedded in a thermally stable carrier. In a preferred embodiment, the carrier is a tubular carrier having a thin layer of the solid substrate deposited on its inner surface, or on its outer surface, or on both its inner and outer surfaces. Such a tubular carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets.

The carrier may be a non-woven fabric or fiber bundle into which tobacco components have been incorporated. The non-woven fabric or fiber bundle may comprise, for example, carbon fibers, natural cellulose fibers, or cellulose derivative fibers.

In a preferred embodiment, the aerosol-generating substrate comprises a tubular substrate having a cavity for receiving the at least one heater element. The heater element may, thus, penetrate into the aerosol-generating substrate. Preferably, the consumable is in the form of a heat stick in which the aerosol-generating substrate, preferably comprising tobacco, is circumscribed by a paper wrapper. Examples of heat sticks include Marlboro IQOS HeatSticks that may be used with an IQOS heating system.

As used herein, "penetrate" in the context of a heating element penetrating into an aerosol-generating substrate, means that the heating element or a portion of the heating element extends into a consumable containing the substrate or extends into a portion of the substrate. For reference, placing an aerosol-generating substrate on a flat heating element, such that the substrate lies on a surface of the heating element, does not constitute the heating element penetrating into the aerosol-generating substrate.

Control electronics and the heating elements of the shisha device may be operably coupled to a power supply. The control electronics may be operably coupled to one or more heating elements to control the timing and extent to which the heating element heats the aerosol-generating substrate in the consumable when the consumable is received in a receptacle. For example, the control electronics may cause the heating element to heat the aerosol-generating substrate to an extent that causes the aerosol-generating substrate in the consumable to heat to a sufficient degree to form an aerosol without combusting the aerosol-generating substrate. The control electronics may independently control each heating element such that the aerosol-generating substrate in a first consumable in a first receptacle is heated at a different time, a different temperature, or at a different time and temperature than an aerosol-generating substrate in a second consumable in a second receptacle.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. The control electronics may include memory that contains instructions that cause one or more components of the control electronics or of the shisha device to carry out a function or aspect of the control electronics. Functions attributable to the control electronics in this disclosure may be embodied as one or more of software, firmware, and hardware.

The shisha device may include apparatus for identifying the type of consumable inserted into a receptacle. Information regarding consumable identity may be used by the control electronics to determine one or both of (i) the aerosol-generating life span of the aerosol-generating substrate in the cartridge, and (ii) the temperature, temperature ramp profile, etc. at which a heating element should be heated to sufficiently heat the aerosol-generating substrate in the consumable to produce an aerosol without burning the substrate. The life span for a particular consumable may be, for example, stored in a look-up table in memory based on typical usage of a shisha device or may be calculated by the control electronics based on the heating profile employed during use of the particular consumable inserted into the receptacle. The consumable may include an identifying element. For example, the consumable may include an RFID tag and the control electronics may include, or be operably coupled to, a RFID reader. As another example, the cartridge may include, or be operably coupled to, an electronic identifying element that electrically couples to a reading element associated with a receptacle when the cartridge is inserted into the receptacle.

The shisha device may include aerosol detecting apparatus operably coupled to the control electronics. The aerosol detecting apparatus and control electronics may be configured to detect a decrease in production of aerosol. Upon detection in a decrease in aerosol production, the control electronics may cause a next heating element in a next receptacle to heat the aerosol generating substrate in a consumable received by the next receptacle; may cause the alarm apparatus to provide a cue to a consumer that the aerosol-generating substrate in the receptacle is nearly depleted; or the like.

Any suitable aerosol detector may be employed. For example, the aerosol detector may comprise a photoelectric detector configured to detect aerosol in an air flow path of the device. The photoelectric detector may comprise a light emission source, such as an LED, and a photocell positioned to detect light emitted from the source. An increase in light detected by the photocell may be indicative of a decrease in aerosol being generated.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Referring now to FIG. 1, a schematic drawing of an example of a shisha device 100 is shown. The device 100 includes a vessel 17 defining an interior volume configured to contain liquid 19 and defining an outlet 18. The liquid 19 preferably comprises water, which may optionally be infused with one or more colorants, flavorants or colorants or flavorants. For example, the water may be infused with one or both of botanical infusions or herbal infusions. The device 100 also comprises a heating and consumable holder assembly 110 configured to hold consumables 20 comprising aerosol-generating substrate. The assembly 110 includes heating elements configured to heat the aerosol-generating substrate in the consumables 20 to aerosolize constituents of the substrate. The device includes a removable cover 16. In use the cover 20 may engage the heating and consumable holder assembly 110 to form an aerosol chamber 130 within the space defined by the cover 20. The cover 20 may be removed to insert or remove the consumables 20. The device 100 also comprises a conduit 15 that extends from the aerosol chamber 130 (within the space defined by the cover 20) into the liquid 19.

An air flow path through the device 100, when the device 100 is in use, is shown by arrows in FIG. 1. When a user draws on outlet 18 or a hose coupled to the outlet 18. Air enters inlets in the heating and consumable holder assembly 110 and preferably flows through or across the consumables 20 to entrain volatile compounds aerosolized by heating of the aerosol generating-substrate in the consumables 20. The air flow carries the aerosolized constituents into the aerosol chamber 130, through the conduit 15, into the liquid 19, and out of outlet 18 for delivery to a user.

Figure 2:
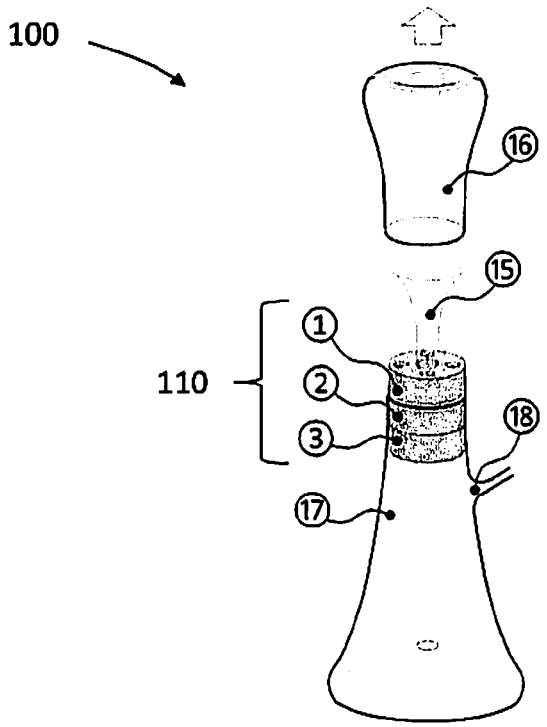
Figure 3:
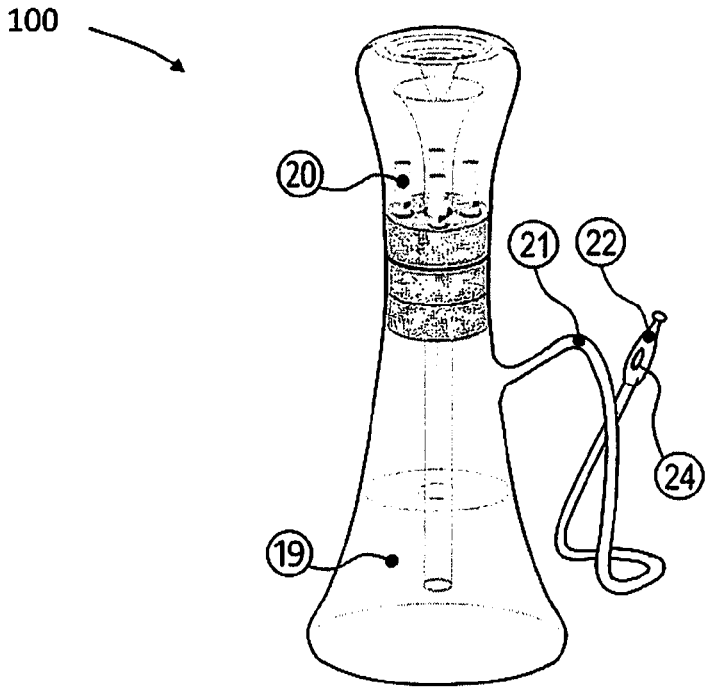

Referring now to FIGS. 2-3, a schematic drawing of an example of a shisha device 100 is shown. In FIG. 3, the device 100 is ready for use by a consumer. The device 100 includes a vessel 17 defining an interior volume configured to contain liquid 19, such as a liquid as described regarding FIG. 1, and defining an outlet 18. The heating and consumable holder assembly 110 of the device 100 depicted in FIG. 2 includes a holder 1, a heating and control unit 2 and a power supply unit 3. The device 100 includes a removable cover 16, which form an aerosol chamber within the space defined by the cover 20 (for example as described regarding FIG. 1). The device 100 also comprises a conduit 15 extending from the aerosol chamber (within the space defined by the cover 20) into the liquid 19 within the vessel 17.

In FIG. 3 consumables 20 are received within the holder and liquid 19 is in the vessel. A flexible tubular member 21, such as a hose, is connected to the outlet 18 of the vessel 17. Any suitable connector may be used to connect the flexible tubular member to the outlet. For example, a quick-release type connector, a threaded-engagement connector, or a bayonette-type connector may be used to connect the flexible tubular member to the outlet. A mouthpiece 22 is connected to the flexible tubular connector 21. The mouthpiece 22 may comprise an actuatable member 24 in communication with control electronics in the control unit 3. For example, actuatable member 24 may be in wireless communication with the control electronics.

Figure 4:
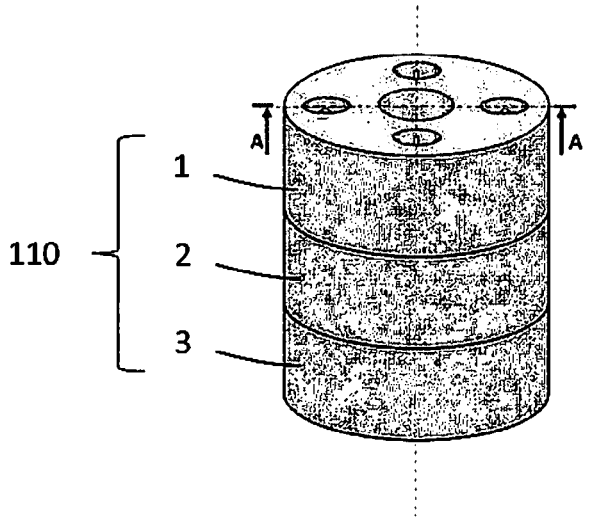
Figure 5:
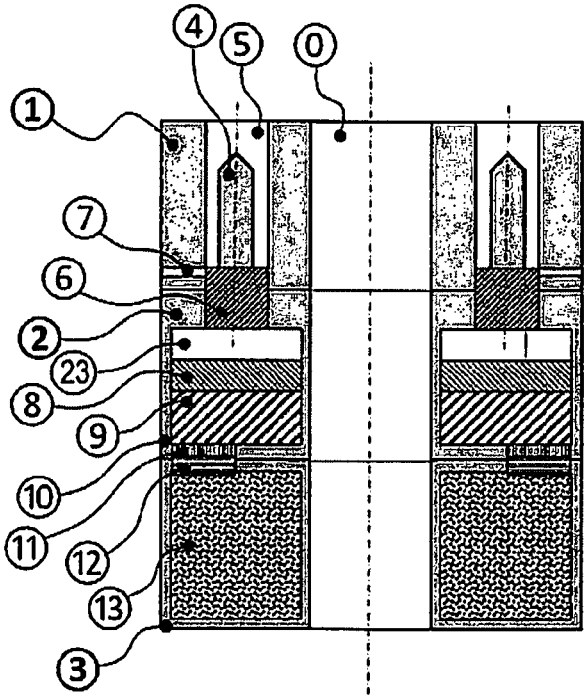
Figure 6:
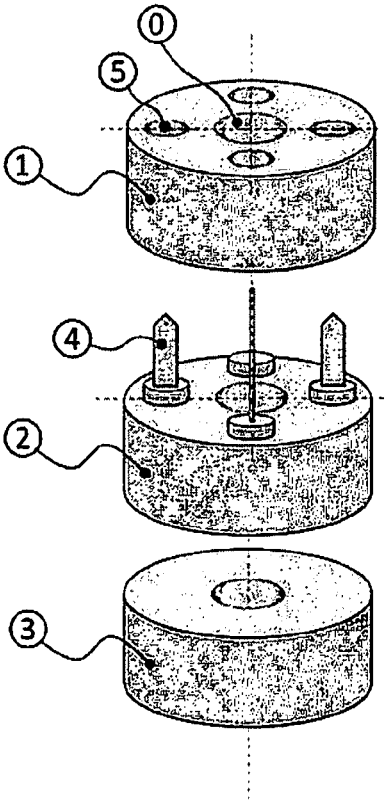
Figure 7:
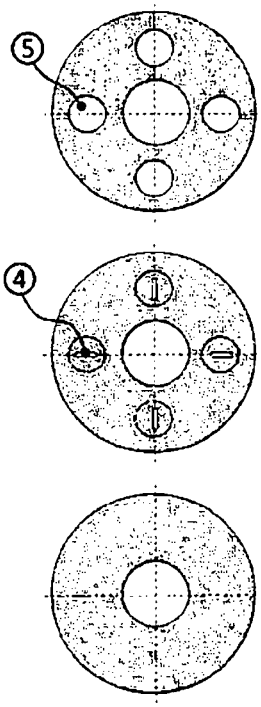

Referring now to FIGS. 4-7, details an example of a heating and holder assembly 110 are shown. FIG. 4 is a schematic perspective view of the assembly 110, which contains a consumable holder 1, a heating and control unit 2, and a power supply unit 3. FIG. 5 is a schematic cross section taken along the longitudinal axis through line A-A of FIG. 4. FIG. 6 is a schematic perspective view of disassembled components; and FIG. 7 is a top down view of a surface of each component.

The holder 1 defines a plurality of receptacles 5 for receiving consumables comprising aerosol-generating substrate. The holder 1 also defines a central opening 0 along its length for receiving (or forming) a conduit (such as conduit 15 depicted in FIG. 1 or FIG. 2). Holder 1 may also define an air inlets 7 in communication with an interior of receptacles 5 to allow air from outside the device through inlet 7 and through or across a consumable received by a receptacle 5.

The heating and control unit 2 includes a heating element 4, such as a blade, that extends into an interior formed by receptacle 5 of holder 1. The heating element 4 may be positioned and configured to pierce a consumable and penetrate into aerosol-generating substrate when the consumable is received by the receptacle 5. A blade or projecting portion of the heating element 4 may be connected to a heating element base 6. Insulating unit 8 includes electrical connections with the heating unit 4. The heating and control unit 2 may include an air gap 23 to provide thermal isolation of electrical or other components and the heating element 4. Electrical connections of insulating unit 8 are also operably coupled to control electronics 9 to operably connect control electronics 9 to the heating element 4. The housing 10 of the heating and control unit 2 may include one or more layer of insulating materials. The heating and control unit 2 includes electrical contacts 11 for electrically coupling the control electronics 9 with the power supply unit 3.

The power supply unit 3 includes a battery 13 or other suitable power supply operably coupled to contact 12 that electrically couples with contact 11 of heating and control unit 2 to electrically couple the battery 13 to the control electronics 9.

The power supply unit 3 and the heating and control unit 2 define a central opening 0 along their length for receiving (or forming) a conduit (such as conduit 15 depicted in FIG. 1 or FIG. 2).

Figure 9:
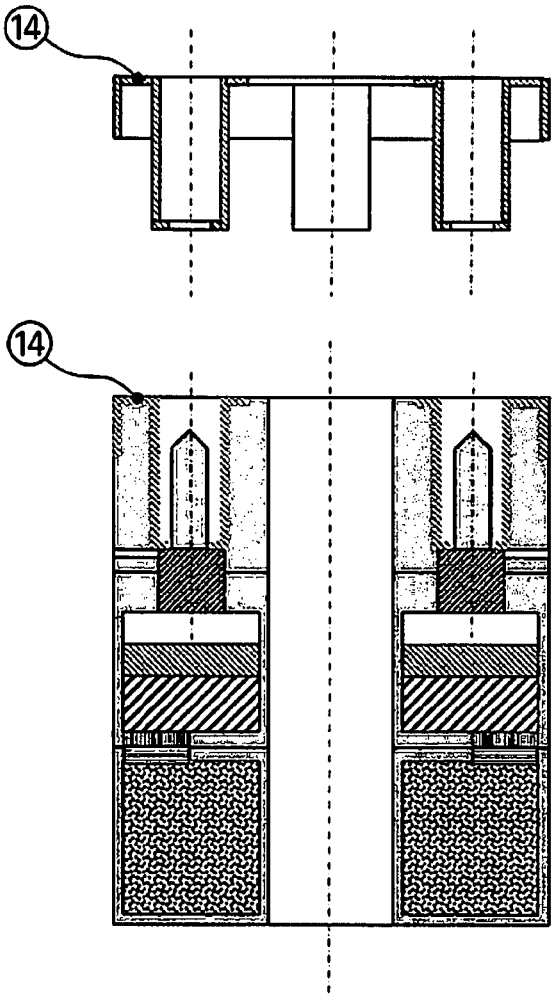
Figure 8:
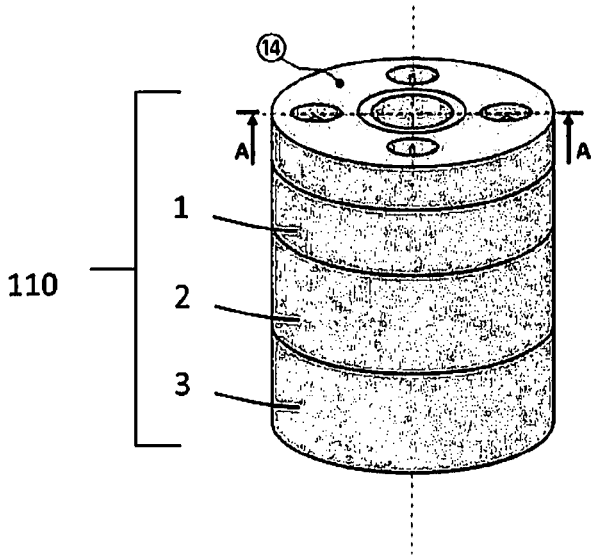

Referring now to FIGS. 8-9, an example of a heating and holder assembly 110 having an optional consumable extraction unit 14 is shown. FIG. 8 depicts a schematic perspective view of the assembly 110, which includes a holder 1, heating and control unit 2, and a power supply unit 3. The holder 1, heating and control unit 2, and a power supply unit 3 may be as described regarding FIGS. 4-7. FIG. 9 depicts a schematic cross-sectional view along the length of the assembly taken along line A-A of the assembly depicted in FIG. 8. The extraction unit 14 may be removable and replaceable by a consumer from the assembly 110 to facilitate extraction of the consumables.

For purposes of example, one method for using a shisha device as described herein is provided below in chronological order. The vessel may be detached from the shisha device and filled with water. One or more of natural fruit juices, botanicals, and herbal infusions may be added to the water for flavoring. The amount of liquid added should cover a portion of the conduit but should not exceed a maximum level mark that may optionally exist on the vessel. The vessel is then reassembled to the shisha device. The cover is removed and consumables are placed into receptacles. Preferably, each receptacle is filled. The consumables may take any shape or form. Preferably, the consumables are heat sticks, such as Philip Morris IQOS heat sticks. The cover is then reassembled to the shisha device. The device is then turned on. A user may puff from a mouth piece until a desired volume of aerosol is produced to fill the aerosol chamber (defined by the inner volume of the cover). The user may puff on the mouth piece as desired. As aerosol generating substrate from one consumable is depleted or nearly depleted, control electronics may cause heating of another consumable to continue the shisha experience. The device may provide a cue, such as an light or acoustic signal to a consumer to inform the consumer that only a few puffs or a short amount of time are left to complete the consumption of the consumables. The user may continue using the device until no more aerosol is visible in the aerosol chamber. Preferably, the device will automatically shut off when all of the consumers are depleted of usable aerosol-generating substrate if the device is not refilled with fresh consumables within a predefined period of time, such as approximately 2 minutes. Alternatively or in addition, the consumer may refill the device with consumables after, for example, receiving the cue from the device that the consumables are depleted or nearly depleted. If refilled with fresh consumables, the device may continue to be used. Preferably, the shisha device can be turned off at any time by a consumer by, for example, switching off the device.

In some examples, a user may activate one or more heating elements by using activation element (such as activation element 24 depicted in FIG. 3) on, for example, the mouthpiece. The activation element may be, for example, in wireless communication with the control electronics and may signal control electronics to activate the heating elements from standby mode to full heating. Preferably, such manual activation is only enabled while the user puffs on the mouthpiece to prevent overheating or unnecessary heating of aerosol-generating substrate in the consumables.

In some examples, the mouthpiece includes a puff sensor in wireless communication with the control electronics and puffing on the mouthpiece by a consumer causes activation of the heating elements from a standby mode to full heating.

A shisha device of the invention may have any suitable air management. In one example, puffing action from the user will create a suction effect causing a low pressure inside the device which will cause the external air to flow through air inlets of the device which conduct the air towards, for example, the inside of the consumables from, for example, the base of the heating elements. Due to the heat caused by the heating elements the aerosol is produced and flushed by the air flowing through the interior of the consumables. The aerosol flows out of the consumables towards the aerosol chamber and then will be conducted through the conduit to the liquid inside the vessel. The aerosol will then bubble out of the liquid and into head space in the vessel above the level of the liquid, and out the outlet for delivery to the consumer. The flow of external air and then the flow of the aerosol inside the shisha device may be automatically driven by the action of puffing from the user.

Any suitable features may be included in a shisha device of the invention. For example, the shisha device may one or more of (i) enable playing of sound from an external source through a loudspeaker via Bluetooth, (ii) use light with different colors to create special environment, and (iii) enable specific signaling of the operation of the device. By way of further example, the shisha device can wireless interface with external devices, such as PCs, smartphones, and wearables, including to be connected and operating to be controlled via software applications hosted in such external devices or through such external devices in cloud. Features of the shisha device can be controlled and customized via apps, and managed, including changing sound source, changing light colors, or choosing automatic programming of light colors.

A shisha device of the invention may be of any suitable size and shape. For example, the total height of the shisha device as fully assembled can be of approximately 180 mm to 410 mm, preferably from 210 to 320 mm. The total width can be of approximately 60 to 180 mm in its narrower transversal cross section and of approximately 80 mm to 200 mm in its larger transversal cross section, as probably coincident to its lower extremity (base). The size of the device may vary to accommodate differing numbers of consumables. For example, a device may accommodate from 1 to 25 consumables, preferably from 4 to 21, and more preferably from 4 to 8 consumables at a time.

A shisha device of the invention may be predominately cylindrical, including fully cylindrical in its external shape.

A power supply unit of a shisha device may be a battery, or set of batteries. In embodiments that are mainly cylindrical embodiments the cathode and anode elements can be rolled and assembled to match such geometries using a hollow housing as described in various figures. The batteries of power supply unit can be rechargeable, as well as it may be removable and replaceable. Any suitable batter may be used. For example, heavy duty type or standard batteries existing in the market, such as used for industrial heavy duty electrical power-tools. Alternatively the power supply unit can be any type of electric power supply including a super or hyper-capacitor. Alternatively the device can be powered connected to an external electrical power source, and electrically and electronically designed for such purpose.

Regardless of the type of power supply employed, the power supply preferably provides sufficient energy for the normal functioning of the device for approximately 70 minutes of continuous operation of the device, before being recharged or needing to connect to an external electrical power source.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Figure 10:
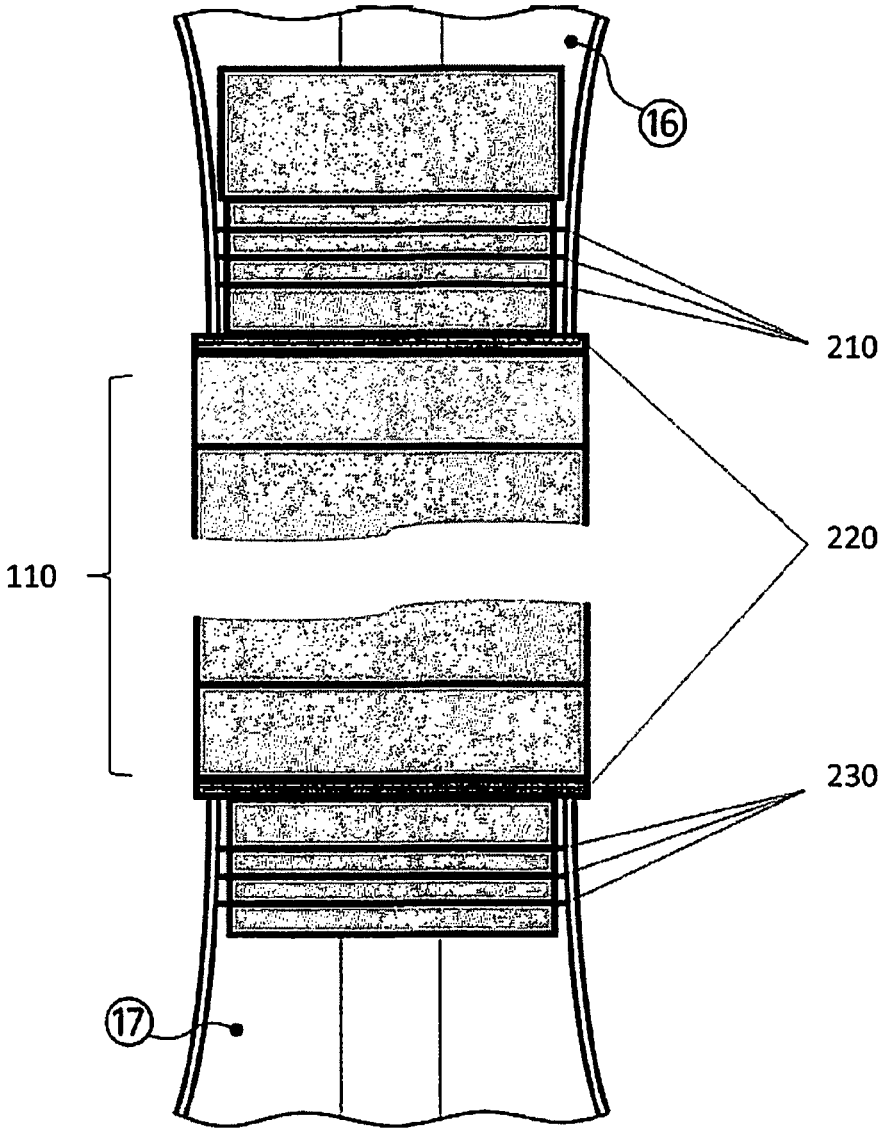

For example and with reference to FIG. 10, a schematic cross section of a portion of an example of a shisha device of the invention is shown. The depicted portion shows hermetic sealing of cover 16, heating and holding assembly 110, and vessel 17. Sealing washers 220 may be disposed on opposing sides of heating and holding assembly 110 to sealingly engage the cover 16 and the vessel. Sealing elements that include sealing rings 210 may sealingly engage an internal surface of the cover 16 and an internal surface of the vessel 17 to ensure hermetic functioning of the shisha device.

Sealing rings and sealing washers, such as those described regarding FIG. 10, may be made of any suitable material or materials. For example, the seals may comprise one or more of graphene compounds and silicon compounds. Preferably, the materials are approved for use in humans by the U.S. Food and Drug Administration.

Aerosol may be purged from the cover or the vessel at any time by removing the cover or the vessel from the shisha device. Alternatively a purging valve may be incorporated in the cover or the vessel to enable purging of aerosol without opening the device.

Main parts, such as the conduit, the cover, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

Other parts may be formed from any suitable materials. In some examples, one or both of holders and extracting units of the invention may be water resistance for normal cleaning/washing with normal water, including use in standard dish washing machines. For example, such parts may comprise transparent or pigmented compounds of polysulfone (PSU), polyethersulfone (PES) or polyphenylsulfone (PPSU), or compounds that are not transparent such as polyether ether ketone (PEEK).

In some examples, a heating and control unit of the invention is overmolded. The overmolding may incorporate at least a portion of the heating element and base of the heating element, associated wiring and electrical contacts. The overmolded piece may incorporate high temperature sealants in one or more specific areas such as in the base of the heating elements, wiring and electric contacts joints.

In some examples, a mouthpiece of the invention incorporates a quick coupling male/female feature to connect to a hose unit.

Control electronics of a shisha device of the invention may be provided in any suitable form and may, for example, include a controller or a memory and a controller. The controller can include one or more of an Application Specific Integrated Circuit (ASIC) state machine, a digital signal processor, a gate array, a microprocessor, or equivalent discrete or integrated logic circuitry. Control electronics can include memory that contains instructions that cause one or more components of the circuitry to carry out a function or aspect of the control electronics. Functions attributable to control electronics in this disclosure can be embodied as one or more of software, firmware, and hardware.

The control electronics may be configured to monitor the electrical resistance of the heating element, and to control the supply of power to the heating element dependent on the electrical resistance of the heating element.

The electronic circuitry may comprise a microprocessor, which may be a programmable microprocessor. The electronic circuitry may be configured to regulate a supply of power. The power may be supplied to the heater element in the form of pulses of electrical current.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Thus, methods, systems, apparatuses, assemblies and articles for shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol generating article manufacturing or related fields are intended to be within the scope of the following claims.

The invention claimed is:

1. A shisha device comprising:

a first receptacle for receiving a first consumable comprising an aerosol-generating substrate;

a second receptacle for receiving a second consumable comprising an aerosol-generating substrate;

a first electrical heating element for heating the aerosol generating substrate in the first consumable when the first consumable is received in the first receptacle to generate an aerosol;

a second electrical heating element for heating the aerosol generating substrate in the second consumable when the second consumable is received in the second receptacle to generate an aerosol; and control electronics operably coupled to the first and second heating elements, wherein the control electronics are configured to:

(a) receive information regarding a temperature profile to heat the aerosol-generating substrate in the first receptacle and time to depletion of the aerosol-generating substrate in the first receptacle when heated according to the temperature profile, (b) cause the first heating element to heat the aerosol-generating substrate of the first consumable received by the first receptacle at the temperature profile, and (c) cause the second heating element to heat the aerosol-generating substrate of the second consumable received by the second receptacle at the time of depletion of the aerosol-generating substrate in the first receptacle, wherein at the time of depletion corresponds to the aerosol-generating substrate in the first receptacle being depleted, or near the time of depletion of the aerosol-generating substrate in the first receptacle, wherein near the time of depletion corresponds to the aerosol-generating substrate in the first receptacle being nearly depleted.

2. The shisha device according to claim 1, wherein the shisha device further comprises a vessel comprising an interior configured to contain liquid and comprising an outlet in communication with the interior of the vessel, wherein the device is configured such that, in use, the aerosol is at least partly carried through a conduit into liquid disposed in the vessel and exits through the outlet for delivery to a consumer.

3. The shisha device according to claim 1, wherein the device is configured such that the first and second heating elements heat the aerosol-generating substrate in the first and second consumables to an extent sufficient to generate an aerosol without combusting the aerosol-generating substrate.

4. The shisha device according to claim 1, wherein the control electronics are configured to cause heating of a third heating element to heat aerosol-generating substrate of a third consumable received by a third receptacle after the aerosol-generating substrate of the second consumable in the second receptacle is depleted or nearly depleted.

5. A method comprising:

inserting the first consumable into the first receptacle and inserting the second consumable into the second receptacle of the shisha device according to any one of claims 1 to 4.

6. The method according to claim 5, wherein the first consumable is an article comprising an aerosol-generating substrate circumscribed by a paper wrapper and wherein the second consumable is an article comprising an aerosol-generating substrate circumscribed by a paper wrapper.

7. The shisha device according to claim 1, further comprising an air inlet, and wherein, in use, the device comprises a flow path configured to cause air entering the device through the inlet to flow across the aerosol-generating substrate when air is drawn through the device.

8. A shisha device according to claim 1, wherein the first receptacle is configured to receive the first consumable, wherein the aerosol generating substrate comprises a solid aerosol forming substrate, wherein the solid aerosol forming substrate comprises tobacco.

* * * * *